US007714733B2

(12) United States Patent
Farley et al.

(10) Patent No.: US 7,714,733 B2
(45) **Date of Patent: *May 11, 2010**

(54) EMERGENCY WARNING SYSTEM INTEGRATED WITH BUILDING HAZARD ALARM NOTIFICATION SYSTEM

(75) Inventors: Daniel G. Farley, Westminster, MA (US); John R. Haynes, Groton, MA (US)

(73) Assignee: SimplexGrinnell LP, Westminster, MA (US)

( * ) Notice: Subject to any disclaimer, the term of this patent is extended or adjusted under 35 U.S.C. 154(b) by 420 days.

This patent is subject to a terminal disclaimer.

(21) Appl. No.: 11/580,654

(22) Filed: Oct. 13, 2006

(65) Prior Publication Data

US 2007/0109114 A1 May 17, 2007

Related U.S. Application Data

(63) Continuation-in-part of application No. 10/914,666, filed on Aug. 9, 2004, now Pat. No. 7,145,466, which is a continuation-in-part of application No. 10/720,810, filed on Nov. 24, 2003, now Pat. No. 7,295,127.

(60) Provisional application No. 60/502,337, filed on Sep. 12, 2003.

(51) Int. Cl.
*G08B 17/10* (2006.01)

(52) U.S. Cl. ..... 340/628; 340/506; 340/3.2; 340/693.3; 340/905

(58) Field of Classification Search ..... 340/506, 340/505, 3.2, 3.52, 3.1, 508, 514, 693.3, 340/601, 539, 690, 905, 311.2, 7.48, 628
See application file for complete search history.

(56) References Cited

U.S. PATENT DOCUMENTS 4,417,217 A 11/1983 Sugiyama
4,641,127 A 2/1987 Hogan et al.
5,278,539 A * 1/1994 Lauterbach et al. .... 340/539.18
5,444,433 A * 8/1995 Gropper ..... 340/601

(Continued)

FOREIGN PATENT DOCUMENTS

EP 0 037 237 A2 10/1981

(Continued)

OTHER PUBLICATIONS

"EAS Safety 1st ", 2004 TFT Inc.; http:/www.tftinc.com/products/datasheets/eas911i.pdf.

(Continued)

*Primary Examiner*—Daniel Previl
(74) *Attorney, Agent, or Firm*—Brinks Hofer Gilson & Lione

(57) ABSTRACT

A hazard alarm system includes a hazard alarm notification appliance, and a warning detector which detects a warning alert message from an external source (such as a governmental organization). The hazard alarm system processes the warning alert message and issues an alarm system alert via the notification appliance. In issuing the alarm system alert, the hazard alarm system determines whether, how, what, where, and/or when to issue the alarm system alert using the notification appliance.

35 Claims, 6 Drawing Sheets

U.S. PATENT DOCUMENTS

| | | | | |
|---|---|---|---|---|
| 5,949,332 | A | 9/1999 | Kim | |
| 6,121,885 | A | 9/2000 | Masone et al. | 340/628 |
| 6,295,001 | B1 * | 9/2001 | Barber | 340/601 |
| 6,379,759 | B2 | 4/2002 | Kamoi | |
| 6,380,860 | B1 | 4/2002 | Goetz | |
| 6,426,697 | B1 * | 7/2002 | Capowski et al. | 340/506 |
| 6,462,665 | B1 * | 10/2002 | Tarlton et al. | 340/601 |
| 6,633,240 | B1 * | 10/2003 | Sweatt | 340/995.1 |
| 6,696,942 | B2 | 2/2004 | Sweatt | |
| 6,710,715 | B2 | 3/2004 | Deeds | |
| 7,049,951 | B2 * | 5/2006 | Rhodes et al. | 340/500 |
| 2004/0085218 | A1 | 5/2004 | Pecora | |
| 2007/0046455 | A1 | 3/2007 | Farley et al. | |
| 2008/0055097 | A1 | 3/2008 | Chidakel et al. | |

FOREIGN PATENT DOCUMENTS

| | | | |
|---|---|---|---|
| EP | 0 269 747 | B1 | 6/1988 |
| EP | 0 811 959 | B1 | 12/1997 |
| EP | 0 834 846 | B1 | 4/1998 |

OTHER PUBLICATIONS

Tony Pugh, "National Warning Systems in Works," published in the Boston Globe on Feb. 25, 2002 in Boston, Massachusetts.

National Public Radio, South Dakota radio reporter, Curt Nickisch reporting on a system designed for emergency notification, Feb. 15, 2002.

* cited by examiner

EMERGENCY WARNING SYSTEM INTEGRATED WITH BUILDING HAZARD ALARM NOTIFICATION SYSTEM

RELATED APPLICATIONS

This application is a continuation-in-part of U.S. application Ser. No. 10/914,666 filed on Aug. 9, 2004 (now U.S. Pat. No. 7,145,466), which is a continuation-in-part of U.S. application Ser. No. 10/720,810 filed on Nov. 24, 2003 (now U.S. Pat. No. 7,295,127), which claims the benefit of U.S. Provisional Application No. 60/502,337, filed on Sep. 12, 2003. U.S. application Ser. No. 10/914,666, U.S. application Ser. No. 10/720,810 and U.S. Provisional Application No. 60/502,337 are hereby incorporated by reference herein in their entirety.

BACKGROUND

Governmental organization may issue warnings to the public in several ways. One way to issue a warning is by using the Emergency Alert System (formerly known as the Emergency Broadcast System). Specifically, the Emergency Alert System is a tool by which the Federal, State and Local Governments may issue warnings to the public about emergency situations. The Emergency Alert System may use digital technology to distribute messages that can be sent through a broadcast station or cable system.

The National Oceanic and Atmospheric Administration (NOAA) is another governmental organization that issues warnings to the public. Specifically, the NOAA may broadcast a message via a radio frequency that may be received by specially equipped radios. The messages may include weather forecasts and warnings, such as news about severe storms, hurricanes, tornadoes, earthquakes and volcanic activity; chemical spills and bio-hazardous releases. Further, in some states, Amber Alerts (or other messages issued to assist in finding missing children) may be broadcast, such as on the same radio frequency as Emergency Alert System messages. The broadcasted messages may include various codes, such as codes to designate the content of the message (e.g., whether the message is local, regional, or national, an Amber Alert, etc.).

The Department of Homeland Security also broadcasts messages to the public. The messages may indicate the status of the current assessed threat level. For example, the message may signal alert conditions, in descending order of urgency of: critical, serious, alert and ready. Or, the message may indicate a specific threat, such as a potential or actual terrorist attack. The Homeland Security messages may be broadcast over the same radio frequency as the NOAA alerts.

Oftentimes, disseminating the emergency messages to the public may prove difficult. People are in a variety of locations, such as at home, at school, at work. The NOAA weather radios designed to receive the NOAA messages may turn themselves on when an alert is broadcast, increasing the likelihood that the alert will be noticed. However, merely relying on the NOAA weather radios (or the television, etc.) may be insufficient since many environments, such as work and school, are not conducive to listening to the radio or watching the television. Moreover, most people do not have the NOAA weather radios limiting the effectiveness of messages disseminated. Therefore, a need exists to more effectively disseminate emergency messages to the public.

SUMMARY OF THE INVENTION

The present invention integrates a warning device with an alarm system. The warning device may receive a warning alert message from a variety of sources, such as governmental organizations such as NOAA, Homeland Security, military agency, etc. The warning device may comprise any device to receive a warning alert message, such as: (1) a warning receiver to receive warnings via radio frequencies, via satellite, or via other wireless communication; (2) an interface to a network such as the Internet; or (3) an interface to a telephone line. The warning device may send the warning alert message to a controller for the alarm system to process the warning alert message. In processing the warning alert message, the controller may determine whether to issue an alert via the alarm system (termed "an alarm system alert"), where to issue the alarm system alert, how to issue the alarm system alert, when to issue the alarm system alert, and what to issue as the alarm system alert.

For example, the alarm system may receive many warning alert messages from the warning device(s). Because of this, the controller may filter which warning alert message to disseminate and which warning alert message not to disseminate. In order to determine whether to disseminate the warning alert message, the controller may analyze any aspect of the warning alert message including: (1) the type of warning alert message (e.g., a warning alert message tagged as a "tornado" message may be disseminated while a warning alert message tagged as a "thunderstorm" message is not disseminated); (2) content of the warning alert message; (3) issuer of the warning alert message (e.g., NOAA, Homeland Security, or military warning alert messages may be disseminated, but Amber Alerts are not disseminated); (4) time of receipt of the warning alert message; (5) comparison of warning alert message with a previously received warning alert message (e.g., a warning alert message issued by Homeland Security with a threat level higher than the previously issued warning alert message); and/or (6) receipt of the warning alert message from at least two sources (e.g., requiring receiving at least two warning alert messages to confirm warning alert message is genuine prior to issuing the alarm system alert).

Further, after the controller determines to disseminate the alarm system alert, the controller may determine how to issue the alarm system alert. The alarm system may have a variety of methods by which to issue an alarm system alert. For example, the alarm system may include a plurality of notification devices to output the alarm system alert. Notification devices may comprise any type of device capable of conveying audio data (such as a loudspeaker), display data (such as a message board, placards, or series of lights), or audio/visual data (such as a video monitor). The controller may determine which output(s) to issue the alarm system alert from the plurality of outputs available. The determination of which output(s) to issue the alarm system alert may be based on any aspect of the warning alert message including: (1) the type of warning alert message; (2) content of the warning alert message; (3) issuer of the warning alert message; and/or (4) time of receipt of the warning alert message.

The controller may also determine where to issue the alarm system alert. Typically, the alarm system may monitor an area, ranging from a floor in an office building, to an entire office complex, to an entire campus. The controller may disseminate the alarm system alert to various parts of the monitored area via the notification device(s) available to the alarm system. In determining where to issue the alarm system alert, the controller may use all of the notification devices available in the alarm system. Or, the controller may select a subset of the notification devices available. In order to determine where to disseminate the warning alert message, the controller may analyze any aspect of the warning alert message including: (1) the type of warning alert message; (2) content of the warning alert message; (3) issuer of the warning alert message; and/or (4) time of receipt of the warning alert message. For example, if a warning alert message is received toward the end of the working day, the controller may disseminate the alarm system alert to notification devices at or near the entrances/exits and the parking lots.

Moreover, the controller may determine what to issue as the alarm system alert. The alarm system alert may comprise a predetermined output, such as a predetermined audio, display, or video output. Or, the alarm system alert may comprise a real-time output, such as replaying an incoming voice message received via a receiver. Or, the alarm system alert may comprise at least a part based on a predetermined output and a part based on a real-time output, such cycling between a predetermined recording and a voice message received.

The controller may further determine when to issue the alarm system alert. The alarm system may determine to issue the alarm system alert immediately, or may determine to delay issuance of the alarm system alert. The determination to delay issuance of the alarm may be based on any aspect of the warning alert message, including: (1) the type of warning alert message; (2) content of the warning alert message; (3) issuer of the warning alert message; and/or (4) time of receipt of the warning alert message.

In addition to (or instead of) issuing an alarm system alert, the controller may modify operation of at least one aspect of the alarm system based on the warning alarm message received. The alarm system may be comprised of various components and may perform various functions. The components may include sensors (such as smoke detectors, motion sensors, lock sensors, biometric sensors, etc.) and inputs (such as keypad inputs, magnetic card-reader inputs, etc.). The functions of the alarm system may include, but are not limited to, monitoring data generated by the various sensors, recording data from the various sensors, controlling electrical and/or mechanical systems (such as HVAC systems, elevator systems, door locks, etc.), and controlling access to all or part of an area monitored by the alarm system. The warning alert message received from a governmental organization may be used to effect operation of one or more components or functions of the alarm system. For example, the controller may monitor an incoming warning alert message indicating a chemical spill to alter the operation of the HVAC system. Specifically, the controller may control the motors of the HVAC system to reduce or minimize the intake of air from exterior of a building in order to reduce the likelihood that the chemicals are introduced into the HVAC system.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention. Moreover, in the figures, like referenced numerals designate corresponding parts throughout the different views.

DETAILED DESCRIPTION OF THE INVENTION

By way of overview, the preferred embodiments described below relate to a method and system for processing a received warning alert message. Warning alert messages are of real value to the public at large. The warning alert messages notify the public of information that must be disseminated immediately. The warning alert messages may relate to many types of alerts, including weather alerts, kidnapping alerts, fire alerts, industrial accident alerts, and terrorism alerts. These types of alerts are listed by way of example. Other types of alerts may be issued as well. Because of the sheer number of types of alerts, it may not be practical for an alarm system to issue all alerts that an alarm system receives. Rather, the alarm system may determine whether, how, when, and what to issue as an alarm system alert.

Figure 1:
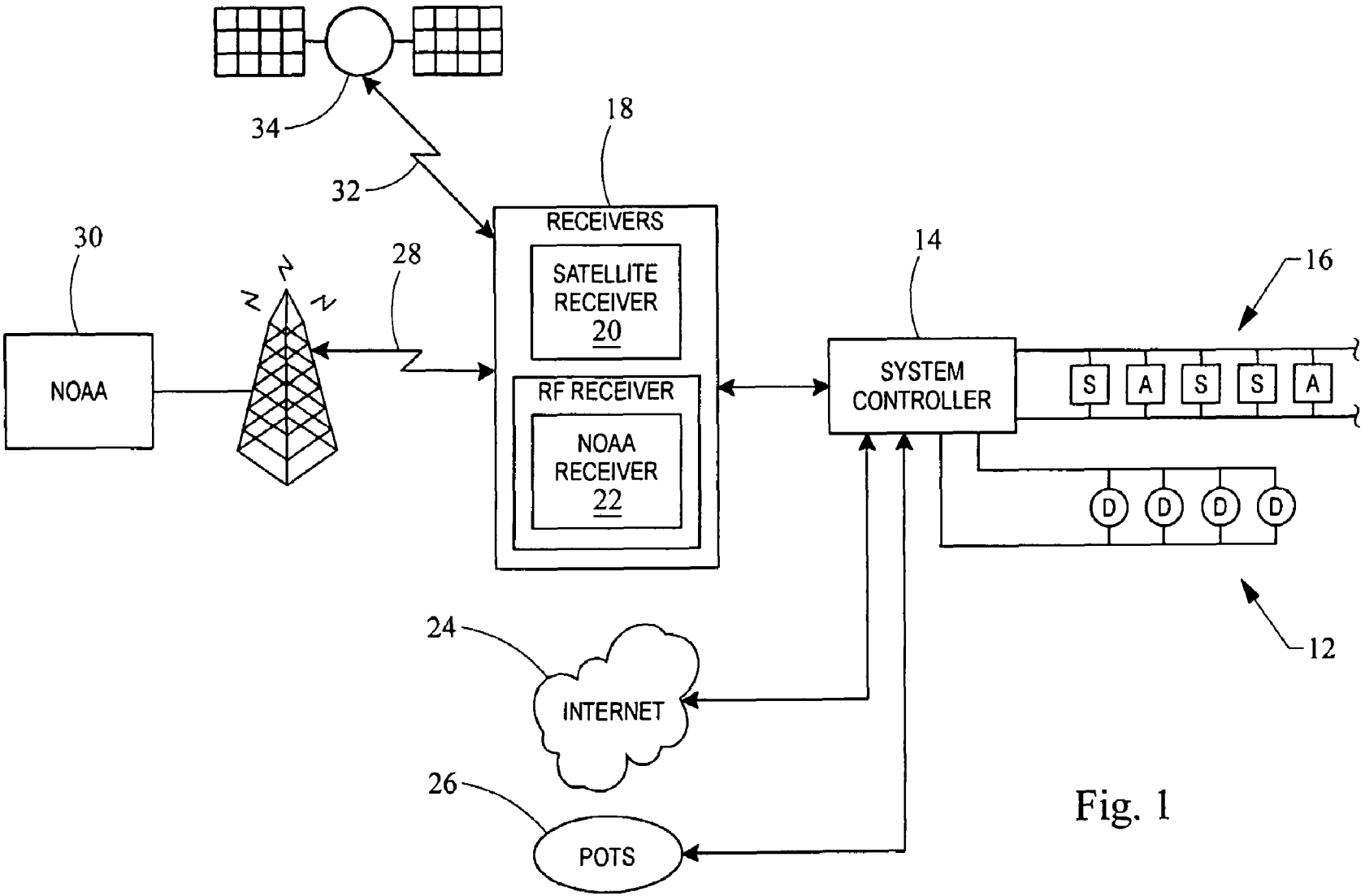
FIG. 1 is a block diagram illustrating an alarm system embodying an example of the present invention.

FIG. 1 is a schematic diagram illustrating an alarm system embodying one example of the present invention. The system may include a system controller 14 that monitors various inputs and controls various outputs of the system. Examples of a system controller 14 may include: a fire alarm panel, a security system (such as an intrusion alert system or access control system either for a home or office), an HVAC (Heating, Ventilation, and Air-Conditioning) system, an Elevator system, or the like. The inputs to the system controller 14 may comprise one or more detector networks 12 having individual fire or smoke detectors D. When a fire or smoke alarm condition is sensed, the system controller 14 may signal the alarm through at least one network 16 of alarm indicators, also called notification appliances. The notification appliances may include any variety of audio output, visual output, and/or audio/visual output, such as audible alarms A and light strobe alarms S.

The system controller 14 may further receive warning alarm messages from a variety of devices (termed "warning devices") designed to receive a warning alert message. For example, the system controller 14 may receive inputs from a receiver 18. Receiver 18 may comprise one or more receivers, such as a satellite receiver 20 and/or a RF receiver (including NOAA weather receiver 22). The satellite receiver 20 may receive satellite transmissions 32 from a satellite 34. Further, the NOAA receiver 22 may receive RF signals 28 from an NOAA transmitting station 40. As shown in FIG. 1, the receivers are components separate from system controller 14. The receiver circuitry and functionality may also be incorporated directly into the system controller 14. As shown in FIG. 1, the warning devices are depicted as separate from the system controller 14. The warning devices may interface with the system controller 14 in a variety of ways, such as via relay contacts, a serial interface device, or a parallel interface device. Alternatively, the warning devices may be incorporated as a module within the system controller 14.

The system controller 14 may also receive warning alert messages via the Internet 24. A governmental organization may send a message via the Internet 24 to the system controller 14. Alternatively, the governmental organization may post its message on a website. The system controller 14 may periodically access the website to determine whether a warning alert message has been issued. Or, the system controller may receive warning alert messages via the Plain Old Telephone System (POTS) 26. One example of using the POTS to receive a warning alert message may include Reverse 911. A warning alert message may be automatically dialed out to phones, such as a telephone number accessible by the system controller. As shown in FIG. 1, the system controller 14 interfaces with the warning devices in a centralized manner. Specifically, the warning devices interface directly with system controller 14, rather than interfacing with one of the audible alarms A or light strobe alarms S.

Figure 2:
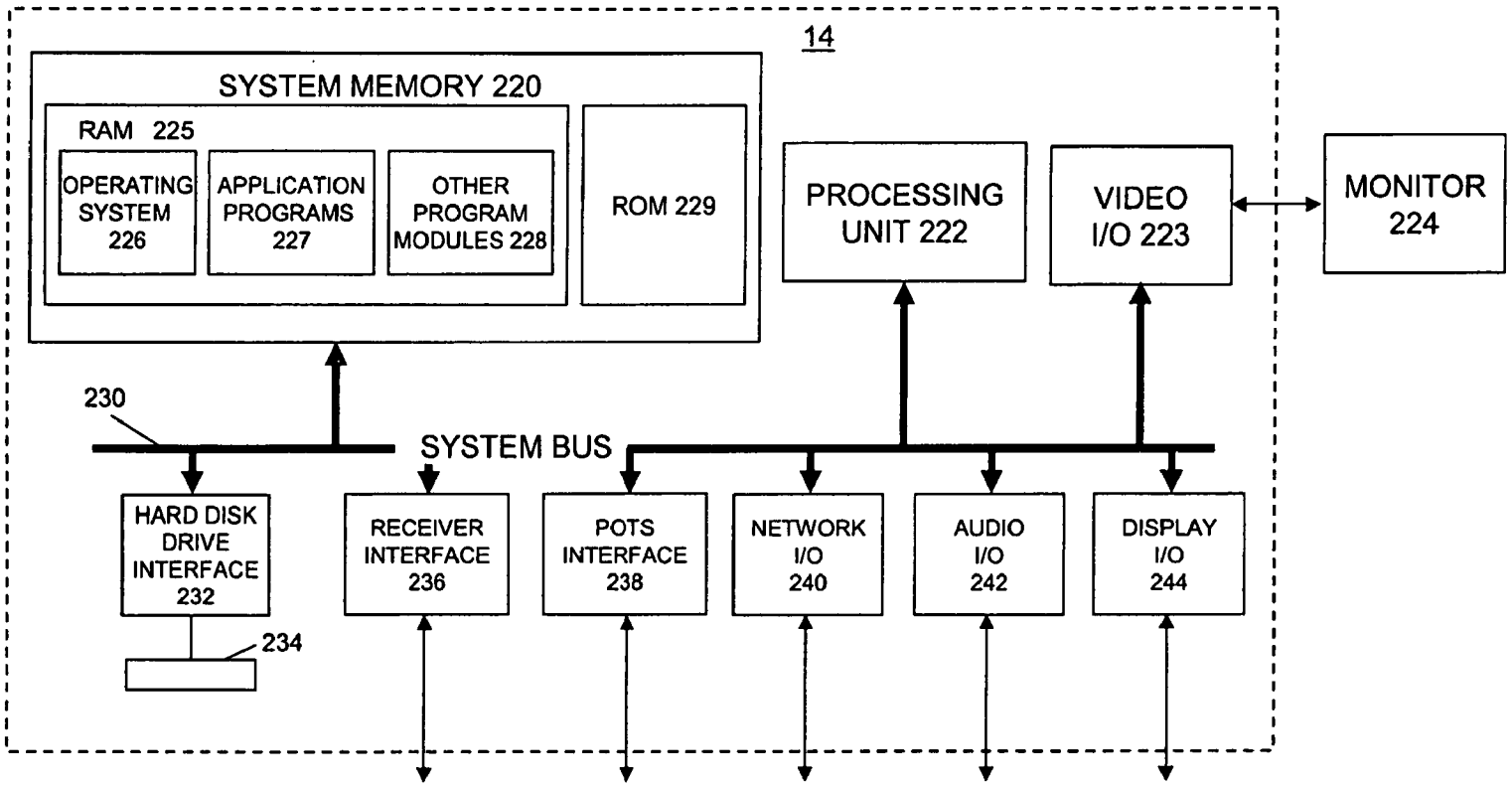
FIG. 2 is a block diagram illustrating the system controller depicted in FIG. 1.

FIG. 2 is a block diagram illustrating the system controller 14 depicted in FIG. 1. The system controller 14 may comprise a general purpose computing device, including a processing unit 222, a system memory 220, and a system bus 230, that couples various system components including the system memory 220 to the processing unit 222. The processing unit 222 may perform arithmetic, logic and/or control operations by accessing system memory 220. The system memory 220 may store information and/or instructions for use in combination with processing unit 222. The system memory 220 may include volatile and non-volatile memory, such as random access memory (RAM) 225 and read only memory (ROM) 229. RAM 225 may include an operating system 226, application programs 227, and other program modules 228. The application programs may include computer-readable programming corresponding to the flow charts in FIGS. 3, 4, and 5. The system bus 230 may be any of several types of bus structures including a memory bus or memory controller, a peripheral bus, and a local bus using any of a variety of bus architectures.

The system controller 14 may receive input from the receivers 18 via receiver interface 236, POTS 26 via POTS interface 238, and the Internet 24 via Network I/O 240. For example, the receiver (such as an NOAA radio) may be interfaced to the system controller 14 through a serial receiver interface device that translates the warning alert message into a recognizable command to the fire alarm panel.

The system controller 14 may further include a hard disk drive interface 232 for reading from and writing to a hard disk 234. The system controller 14 may further communicate with various notification devices, such as audio devices, display devices, and audio/video devices. As shown in FIG. 2, the system controller 14 communicates with audio notification devices via audio I/O 242, with display notification devices via display I/O 244, and with video notification devices (such as monitor 224) via video I/O 223. The audio I/O 242 may communicate with one or more loudspeakers. For example, the audio I/O 242 may communicate with an existing loudspeaker system, such as a public address system. Though FIG. 2 depicts the display and video notification I/O 223, 224 as separate elements, the functionality of inputting and outputting information to the notification devices may be performed by a single or multiple elements.

Figure 3:
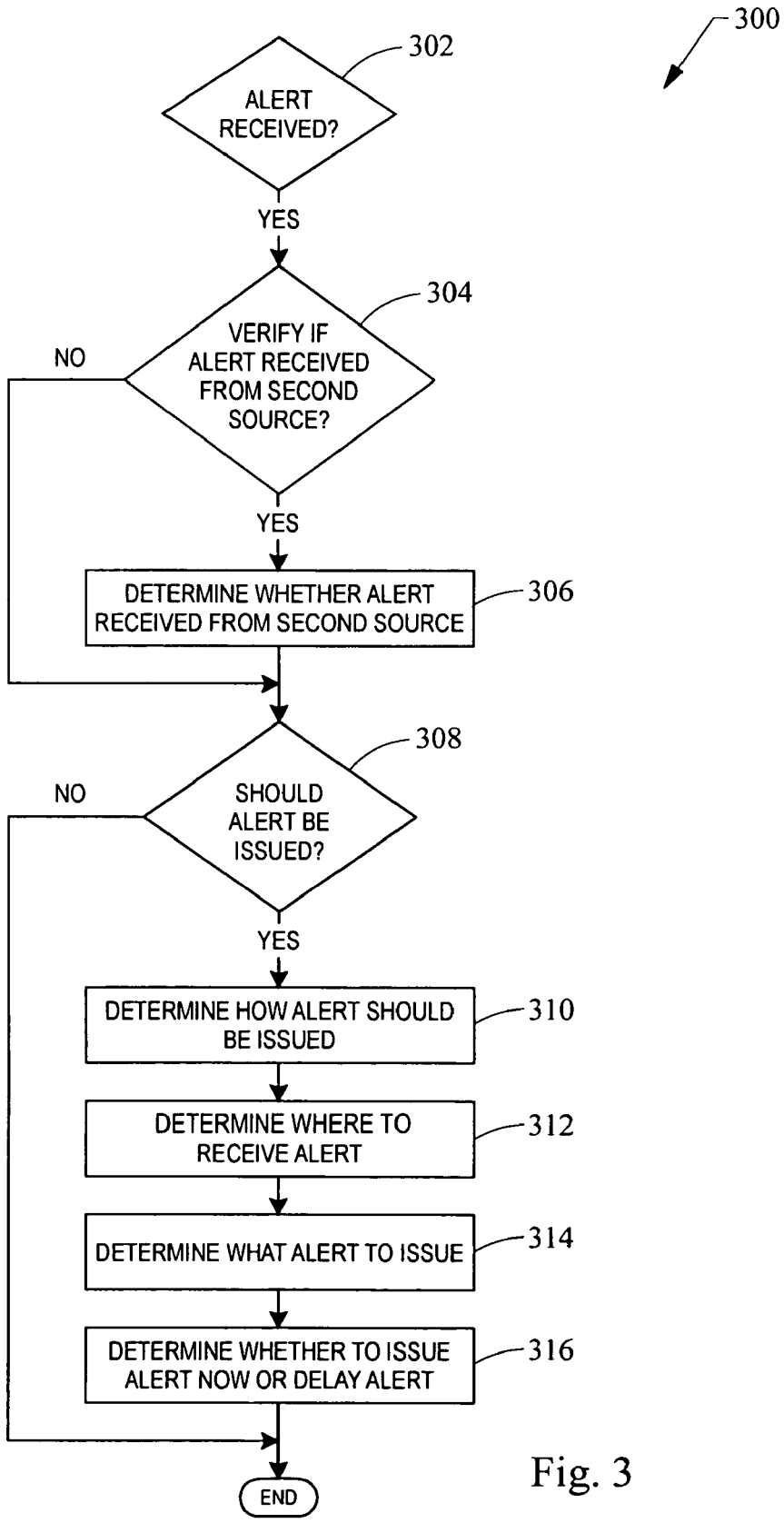
FIG. 3 is a flow chart of an example of processing a warning alert message.

FIG. 3 is a flow chart 300 of an example of processing a warning alert message. As shown at block 302, it is determined if a warning alert message has been received. As discussed above, many different types of warning alert messages may be received. One type of message may include a national alert signal transmitted to a NOAA weather radio that functions as a receiver. The warning alert message may comprise information about weather, homeland security, or military communications.

When a warning alert message has been received, the system controller 14 may determine whether to verify if the warning message alert has been received from multiple sources (such as a second source), as shown at block 304. In some instances, one may wish to process a warning alert message only after receiving confirmation of the warning alert message (such as receiving confirmation either from one or more different receivers, or from the same receiver receiving the warning alert message a second time). If this is the case, the system controller may determine whether the warning alert message has been received from a second source, as shown at block 306. This determination may include a comparison of at least one aspect of the originally received warning alert message with at least one aspect of a subsequently received warning alert message. The comparison may include comparing one or more tags associated with the warning alert messages. Or, the comparison may include comparing whether the message payload (e.g., the message to be disseminated) in the warning alert messages are substantially similar. Alternatively, the system controller 14 may incorporate a fixed or variable delay before issuing the alarm system alert within the building for some pre-determined time period to give local building authorities time to confirm the validity of the received warning alert message.

Figure 4:
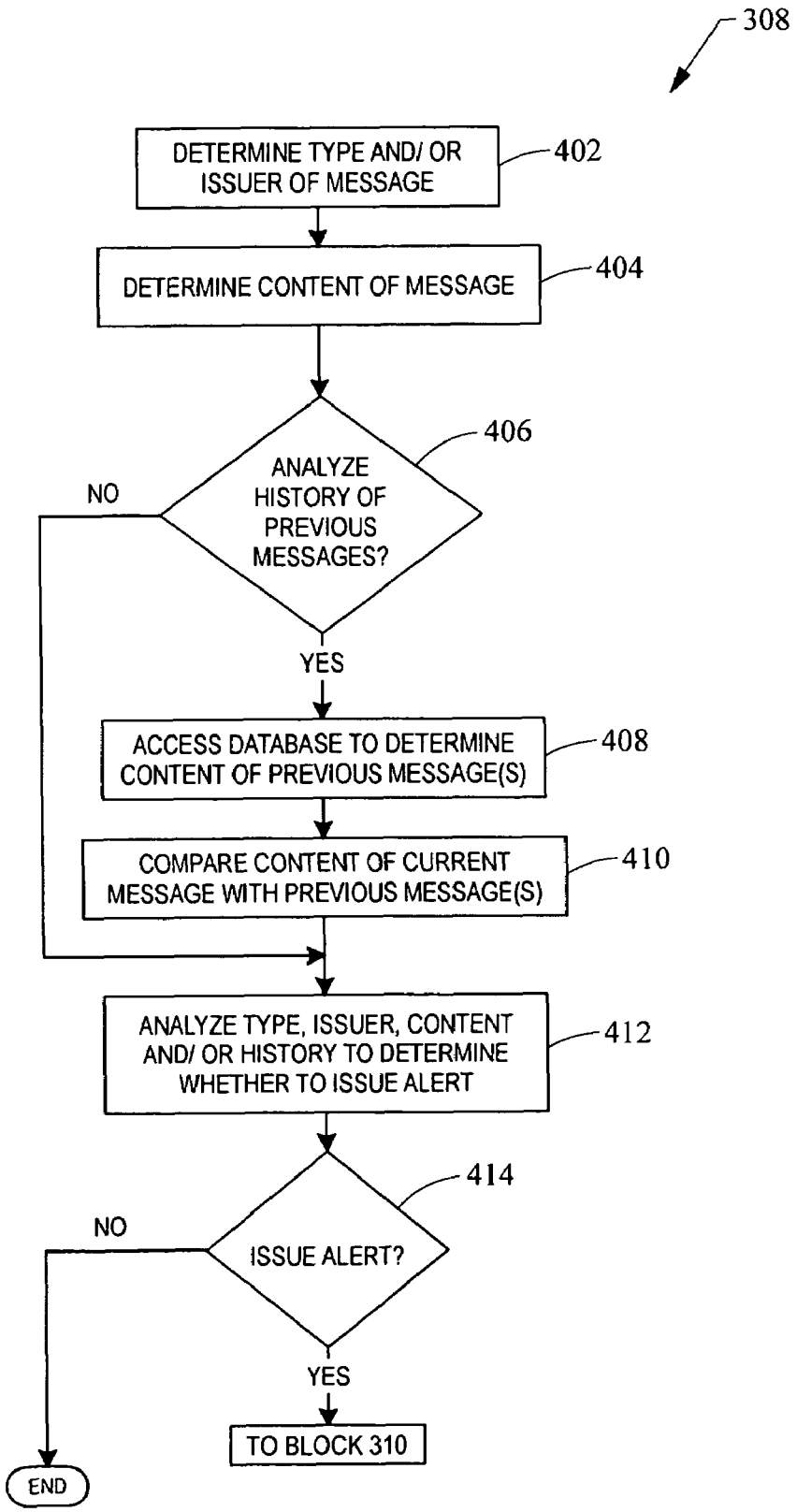
FIG. 4 is a flow chart of an example of determining whether to issue an alarm system alert when processing a warning alert message in FIG. 3.
Figure 5:
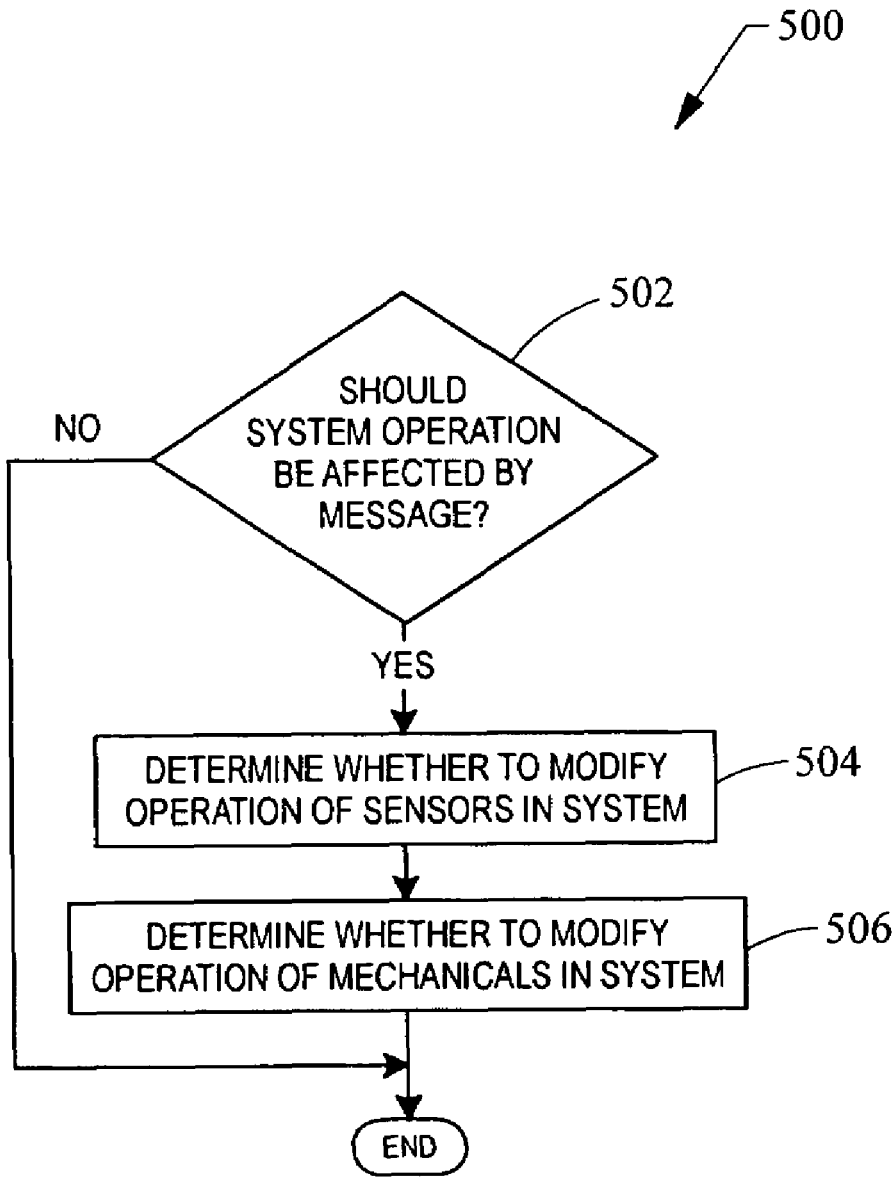
FIG. 5 is a flow chart of an example of modifying operation of the alarm system based on a warning alert message.

As shown at block 308, it is determined whether the alarm system alert should be issued. Because many warning alert messages may be received, the system controller 14 may determine which of the warning alert messages received may be processed and issued as alerts for the alarm system. Referring to FIG. 4, there is shown an expanded flow chart for block 308. The system controller 14 may analyze any aspect of the warning alert message to determine whether to issue an alarm system alert.

In addition, it may be determined whether to communicate the alarm system alert to another alarm system. Alarm systems in different locations may be inter-related, such as the alarm systems of a multi-city or multi-national corporation. Certain alarm system alerts may not be of interest to an alarm system in a different city. For example, a tornado warning issued for the New York City area may be of little interest to an alarm system in London. Other alarm system alerts may be of additional interest. For example, an increased terror threat level issued in New York City (or in the United States) may be of interest to other offices of a corporation. The system controller 14 may send the alarm system alert to another alarm system via the Internet 24 or other means. In this manner, a local, national, or international corporation may communicate alerts to one, some, or all of its locations based on the warning alert message received.

As shown at block 402, the system controller may determine the type and/or issuer of the warning alert message. An aspect of the warning alert message may indicate a type of message and/or may indicate the issuer of the message. For example, the warning alert message may include a tag, header information, or the like to indicate the type or issuer of the message. The type of message may generally relate to the type of warning. For example, the type of message may comprise a national, regional, or local warning alert message. The system controller may prioritize the messages received based on the geographic scope of the message, such as prioritizing national messages over regional messages, or prioritizing local messages over national message (such as a local fire warning alert message may take priority over and be issued before a national warning alert message). As another example, with weather-related messages, the type of message may include "tornado," "thunderstorm," etc. The warning alert message may thus include data indicative of the type of message, such as a specific tag to indicate the message relates to a tornado warning. In determining the type of warning alert message, the system controller 14 may compare the specific tag in the warning alert message with a set of predetermined tags. If the specific tag is matched to one of the predetermined tags, the system controller 14 may determine the type of warning alert message. Similarly, the warning alert message may be indicative of the issuer of the message. For example, a tag may indicate that the message was issued by Homeland Security. Alternatively, the warning alert message may be transmitted in a certain manner, such as a particular frequency band, to indicate the issuer of the message (e.g., an issuer may issue messages at a specific radio frequency).

Further, the content of the warning alert message may be determined, as shown at block 404. The content of the message may comprise text, audio, or video. The system controller 14 may segment the content of the warning alert message in system memory 220 for further processing, as discussed below.

As shown at block 406, it is determined whether to analyze a history of previous warning alert messages. The determination whether to issue an alarm system alert may depend, in part, on previously received warning alert message(s). For example, if the system controller only issues alarm system alerts for changes in the threat level for homeland security, to determine whether to issue an alarm system alert includes comparing the threat level in the current warning alert message with the threat level in the previously received warning message. As shown at block 408, the system controller 14 may access a database (such as system memory 220) to determine the content of previous message. The content of the previous message may then be compared with the content of the current message, as shown at block 410. In the example discussed above regarding the threat level, the comparison of the messages may indicate that the threat level has changed.

Based on one, some, or all, of the type, issuer, content or history, the system controller 14 may determine whether to issue an alarm system alert, as shown at block 412. The system controller may access a set of rules to determine whether to issue an alarm system alert. Specifically, each of the examples provided above may be incorporated into a rule for the system controller 14 to access when determining whether to issue an alarm system alert. Whether to issue an alert is checked at block 414. If an alarm system alert is to be issued, the flow diagram returns to block 310. If not, the processing may end.

As shown at block 310, the system controller 14 may determine how the alert should be issued. As discussed above, the alarm system may include different types of notification devices. The notification devices may include audible, visual, and audible/visual notification. Further, each type of notification device may include many different sub-types of notification devices. For example, a visual notification device may comprise a monitor (such as a video monitor) for displaying pictures or text, or a placard. In the event that a warning alert message comprises a video (such as a streaming video received via Internet 24), the system controller 14 may display the streaming video on a part or all of the video monitor. For example, the streaming video may be displayed on the entire portion of the video monitor. As another example, the streaming video may be displayed on a part of the video monitor (such as ½ of the monitor) and another part of the video monitor may display information or instructions generated by the system controller 14. The information or instructions may comprise a recommendation to take action (such as in the case of a fire, a picture or video of the recommended exit strategy may be displayed). The information or instructions may also comprise a live video feed of a camera on the premises of the alarm system.

Figure 6:
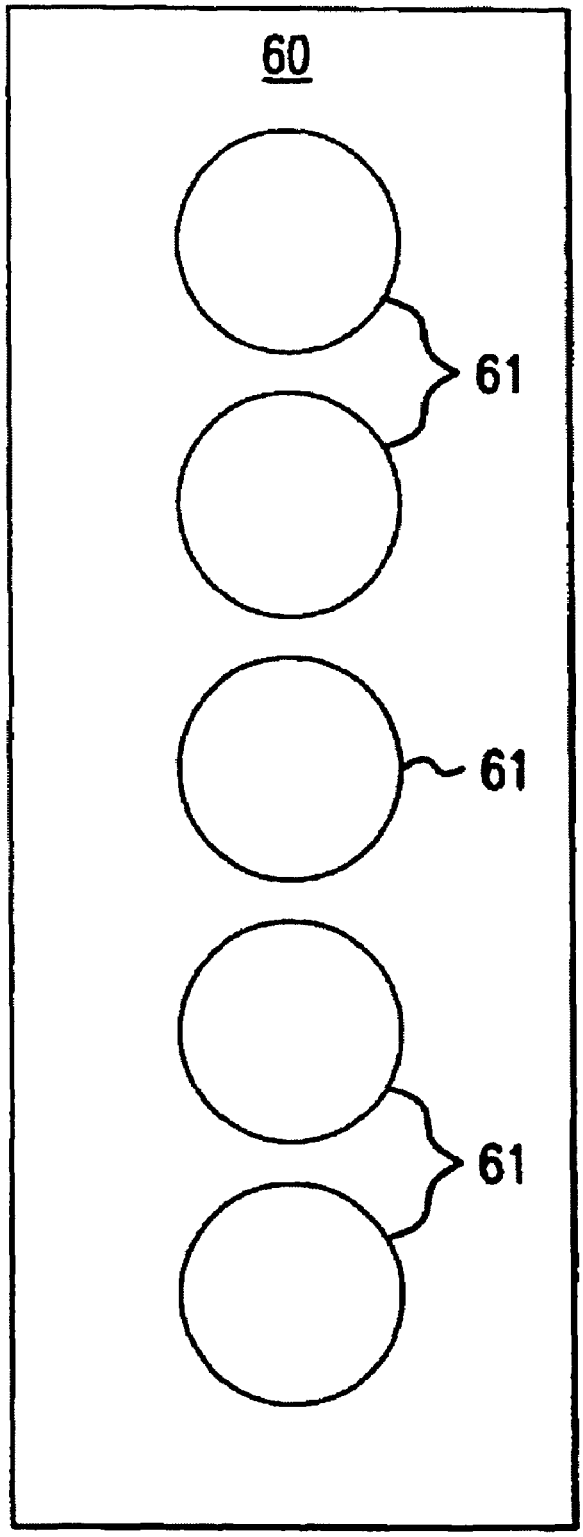
FIG. 6 is a schematic diagram of a visual annunciator.

Or, the visual notification device may comprise a visual annunciator 60, as shown in FIG. 6. The visual annunciator may provide a continuous indication of the alert level for homeland security. The visual annunciator may have several visual indicators 61, e.g., lights or LEDs, which are preferably color-coded and correspond to the various emergency levels defined by the NOAA or other agency. The annunciator 60 may be integrated with or mounted on the fire control panel, or may stand as a separate unit apart from, but in communication with, the fire control panel. Five visual indicators are shown in FIG. 6 for illustrative purposes; however, one skilled in the art would recognize that a visual annunciator with a different number of visual indicators would fall within the scope of the present invention. The annunciator 60 may comprise a series of LEDs (light emitting diodes) with an actual size on the order of that shown in FIG. 6, or may comprise a series of lights akin to the size of a traffic light greater than that shown in FIG. 6. Further, the annunciator 60 may work in combination with other notification devices, such as a text display.

The system controller 14 may select all of the notification devices available to issue the alarm system alert. Or, the system controller 14 may select a subset of the notification devices available, such as one or some of the notification devices. The selection of the subset of the notification devices available may be based on any aspect of the warning alert message including: (1) the type of warning alert message; (2) content of the warning alert message; (3) issuer of the warning alert message; and/or (4) time of receipt of the warning alert message. Rules may be stored in system memory 220 to select the subset of the notification devices based on any one, some, or all of the factors listed above. For example, an entrance to a building may have one or more notification devices. The system controller may select one of the notifications devices in the entrance to issue the alarm system alert.

As shown at block 312, the system controller 14 may determine where to issue the alert system alert. The alarm system alert may be issued within the alarm system, or may be issued outside of the alarm system. For example, the alarm system alert may be issued at any notification appliance in the alarm system. As discussed above, the alarm system may have areas of different sizes. Further, the notification devices may be distributed in various parts of the area monitored by the alarm system. The system controller 14 may select all of the notification devices available to issue the alarm system alert to the entire area monitored. Or, the system controller 14 may select a subset of the area monitored. In order to determine where to disseminate the warning alert message, the controller may analyze any aspect of the warning alert message including: (1) the type of warning alert message; (2) content of the warning alert message; (3) issuer of the warning alert message; and/or (4) time of receipt of the warning alert message. For example, if the warning alert message comprises a weather warning, the alarm system alert may be directed to areas outdoors to caution people to move indoors. As another example, if a warning alert message is received toward the end of the working day, the system controller may disseminate the alarm system alert to notification devices at or near the entrances/exits and the parking lots. Still another example, if the warning alert message is received in the middle of the working day, the system controller may disseminate the alarm system alert to the cafeteria and other public places. In still another example, the alarm system alert may be different for different notification devices. For example, in the event of a fire in a building, the warning system alert may be different for different parts of the building. Specifically, the alarm system alert may be different for different floors in the building, with the floor at which the fire is located receiving a different alarm system alert than the one(s) for other floors in the building.

In addition to, or instead of, the alarm system alert may be issued to devices outside of the alarm system, such as pagers, cellular telephones, landline telephones, electronic mail addresses or the like. The devices selected to receive the alarm system alert may depend on the type of warning alert message, the time of receipt of the warning alert message, and the like. For example, the system controller 14 may select a cellular telephone to issue the alarm system alert for a terrorist warning alert. As another example, pagers for certain hospital staff may receive alerts as to various received warning alert messages.

As shown at block 314, the system controller 14 may determine what alarm system alert to issue. Various types of messages may be generated for the alarm system alert. For example, the alarm system alert may comprise a predetermined audio, display, and/or video for a particular warning alert message, such as a particular type, content, or issuer of the message. In particular, the system controller 14 may issue a pre-recorded audio output such as "Tornado Warning In Effect" as the alarm system alert if the warning alert message comprises a tornado warning. Alternatively, notification horns and strobes may be used to signal building occupants using pre-defined patterns, e.g., temporal code. Moreover, the prerecorded message may include information regarding the incoming warning alert message, as well as directions how to respond. For example, the system controller may issue one of the following alarm system alerts: "A critical security alert has been received. Immediately implement response plan 1; " or "A ready security alert has been received. No action is required at this time. Stay tuned for further information." As another example, in the event of a tornado warning, the system controller may issue different pre-recorded messages. As discussed elsewhere, the pre-recorded messages may be different based on where the alarm system alert is issued. Specifically, the alarm system alert may be tailored to provide directions to the nearest tornado shelter (e.g., one notification appliance on the second floor may state "A tornado warning has been received; please proceed down the stairway to the tornado shelter in room 101, whereas another notification appliance on the first floor may state "A tornado warning has been received; please proceed down the hallway to room 101).

Or, the alarm system alert may be dynamically generated, such as being based on the content of the warning alert message. For example, an Amber Alert warning alert message may include content such as "Jane Doe, white female, 5 years old, was abducted from Capital City noon on Tuesday, Nov. 4, 2007. " The alarm system alert may convert the content of the warning alert message into audio for output on loudspeakers. As still another example, the alarm system alert may be a combination of a predetermined message and a dynamic message. The dynamic portion of the message may be sent to the notification devices with its content unaltered, such as sending a text message in an Amber Alert to a readerboard (or other type of signage that displays text messages) or to a speaker (subsequent to conversion of the text to speech using a speech generator), or sending an audio message to a speaker. Or, the dynamic portion of the message may be sent to the notification device with some of its content altered, such as by deleting a part of the message. In the Amber Alert example, the alarm system alert may cycle between a predetermined message and the incoming message detailing the specific description of the child missing, such as "Amber Alert issued; Jane Doe, white female, 5 years old, was abducted from Capital City noon on Tuesday, Nov. 4, 2007. " Further, the system controller may combine various portions of the warning alert message for output on one of the notification devices. For example, an Amber Alert message may include a picture of a child and a description of the child. The system controller may arrange the description of the child underneath the picture of the child for display on a monitor. Further, as discussed above, the warning alert message may comprise video, with the video being output along with dynamically generated video output (such as output from a camera on the premises of the alarm system).

As shown at block 316, the system controller 14 may determine when to issue the alarm system alert. The alarm system may determine to issue the alarm system alert immediately, or may determine to delay issuance of the alarm system alert. The determination to delay issuance of the alarm may be based on any aspect of the warning alert message, including: (1) the type of warning alert message; (2) content of the warning alert message; (3) issuer of the warning alert message; and/or (4) time of receipt of the warning alert message. For example, a warning alert message received during non-business hours may be delayed until the next business morning. FIG. 3 depicts an example of a flow chart for issuing an alarm system alert, determining whether, how, where, what, and when to issue the alert. Any one, some or all of the determining steps may be used in issuing an alarm system alert.

In combination with or instead of issuing an alarm system alert, the system controller 14 may modify operation of at least one aspect of the alarm system based on the warning alarm message received. The alarm system may be comprised of various components and may perform various functions. The components may include sensors (such as smoke detectors, motion sensors, lock sensors, biometric sensors, etc.) and inputs (such as keypad inputs, magnetic card-reader inputs, etc.). The functions of the alarm system may include, but are not limited to, monitoring data generated by the various sensors, recording data from the various sensors, controlling electrical and/or mechanical systems (such as HVAC systems, elevator systems, door locks, etc.), and controlling access to all or part of an area monitored by the alarm system. The warning alert message may be used to effect operation of one or more components or functions of the alarm system. For example, the system controller 14 may monitor an incoming warning alert message indicating a chemical spill to alter the operation of the HVAC system. Specifically, the controller may control the motors of the HVAC system to reduce or minimize the intake of air from exterior of a building in order to reduce the likelihood that the chemicals are introduced into the HVAC system. As another example, the warning alert message may modify the operation of the door locks in a building, such as a home, school or office. The system controller 14 may lock the doors automatically based on the warning alert message (such as based on an Amber Alert message), or may unlock the doors automatically based on the warning alert message (such as based on a fire alarm message). Specifically, one, some, or all of the locks in an alarm system may normally be open; with a warning alert message directed to a homeland security threat, one, some or all of the locks may be closed. In the case of magnetic door locks, the system controller 14 may either lock the doors by de-energizing the magnetic locks, or may unlock the doors by energizing the locks. As still another example, the warning alert message may modify response to one or more sensors in the alarm system. The alarm system may include sensors with varying degrees of sensitivity. The system controller 14 may send a command to the sensors to increase their sensitivity in the event of a specific type of warning alert message (such as a homeland security threat). The alarm system may also include cameras. The operation of the cameras, such as whether the cameras are turned on or whether the video generated from the cameras is recorded, may be controlled based on the warning alert message received. For example, in a homeland security threat warning, one, some, or all of the cameras in the alarm system may be turned on, and may generate video for recording.

While this invention has been particularly shown and described with references to preferred embodiments thereof, it will be understood by those skilled in the art that various changes in form and details may be made therein without departing from the scope of the invention encompassed by the appended claims.

The invention claimed is:

1. A hazard alarm system, comprising:

a warning device for receiving a warning alert message from a source external to the hazard alarm system;

a system controller for the hazard alarm system in communication with the warning device and receiving the warning alert message from the warning device, the system controller determining whether to issue an alarm system alert based on at least one aspect of the warning alert message received;

at least one notification appliance in communication with the system controller, the system controller sending the alarm system alert to the at least one notification appliance based on the warning alert message if the system controller determines to issue the alarm system alert; and at least one hazard detector that detects any of fire, heat, and smoke, the hazard detector in communication with the system controller and being separate from the warning device, wherein the system controller receives data from the at least one hazard detector in order to determine whether to issue a hazard detector alert, and wherein the system controller sends the hazard detector alert to the at least one notification appliance if the system controller determines to issue the hazard detector alert.

2. The hazard alarm system of claim 1, wherein the warning device comprises a warning receiver for receiving the warning alert message; and wherein the system controller is in communication with the warning receiver.

3. The hazard alarm system of claim 1, wherein the warning device comprises a network interface device for receiving the warning alert message via an Internet.

4. The hazard alarm system of claim 1, wherein the warning alert message comprises a type of message;

wherein the system controller determines the type of the warning alert message; and wherein the system controller determines whether to issue the alarm system alert based on the type of warning alert message.

5. The hazard alarm system of claim 1, wherein the warning alert message comprises a tag to indicate the at least one aspect of the warning alert message; and wherein the system controller determines whether to issue the alarm system alert based on the tag.

6. The hazard alarm system of claim 1, wherein the hazard alarm system comprises a plurality of notification appliances; and wherein the system controller determines which, of the plurality of notification appliances, to send the warning alert message to in order to issue the alarm system alert.

7. The hazard alarm system of claim 6, wherein the system controller determines which, of the plurality of notification appliances, to send the warning alert message to based on at least one of time of receipt of the warning alert message or type of the warning alert message.

8. The hazard alarm system of claim 1, wherein the warning alert message comprises a current warning alert message; and wherein the system controller determines whether to issue an alarm system alert based on analyzing a history of at least one stored warning alert message, the stored warning alert message being received prior to the current warning alert message.

9. The hazard alarm system of claim 8, wherein the system controller determines whether to issue an alarm system alert by comparing the stored warning alert message with the current warning alert message to determine if the stored warning alert message is different from the current warning alert message.

10. The hazard alarm system of claim 9, wherein the system controller determines whether to issue an alarm system alert by determining whether a threat level in the current warning alert message is greater than the threat level in the stored warning alert message.

11. The hazard alarm system of claim 1, wherein the system controller dynamically creates a content of the alarm system alert.

12. The hazard alarm system of claim 11, wherein the warning alert message received from the warning device comprises a dynamic message; and wherein at least a part of the alarm system alert created by the system controller is based on the dynamic message.

13. The hazard alarm system of claim 12, wherein at least a part of the alarm system alert created by the system controller is based on the dynamic message and based on a stored message; and wherein the notification appliance cycles between issuing the dynamic message and the stored message.

14. The hazard alarm system of claim 1, wherein the system controller determines when to issue the alarm system alert.

15. The hazard alarm system of claim 14, wherein the system controller determines to delay issuance of the alarm system alert.

16. The hazard alarm system of claim 1 further comprising:

at least one, device for monitoring the area; and wherein the system controller modifies operation of the at least one device based on the warning alert message received.

17. The hazard alarm system of claim 16, wherein the at least one device comprises an environmental control device for the area.

18. The hazard alarm system of claim 17, wherein the environmental control device comprises an HVAC system; and wherein modifying operation comprises modifying flow of air in the HVAC system based on the warning alert message received.

19. The method of claim 16, wherein the system controller automatically determines whether to issue the alarm system alert based on the at least one aspect of the warning alert message received.

20. The method of claim 16, wherein the hazard detector communicates to the system controller data indicative of detection of at least one of fire, heat, and smoke;

wherein the system controller determines whether to issue a hazard detector alert based on the data; and wherein the system controller sends the hazard detector alert to the notification appliance to issue the hazard detector alert.

21. The hazard alarm system of claim 1, wherein the system controller automatically determines whether to issue the alarm system alert based on the at least one aspect of the warning alert message received.

22. The hazard alarm system of claim 1, wherein the hazard detector communicates to the system controller data indicative of detection of at least one of fire, heat, and smoke;

wherein the system controller determines whether to issue a hazard detector alert based on the data; and wherein the system controller sends the hazard detector alert to the notification appliance to issue the hazard detector alert.

23. The hazard alarm system of claim 1 further comprising:

at least one device for controlling the area; and wherein the system controller modifies operation of the at least one device based on the warning alert message received.

24. A method, in a hazard alarm system, for providing warnings, the hazard alarm system comprising a warning device for receiving a warning alert message, a system controller for the hazard alarm system in communication with the warning device, at least one hazard notification appliance in communication with the system controller, and at least one hazard detector that detects any of fire, heat, and smoke, the hazard detector in communication with the system controller and being separate from the warning device, the method comprising:

detecting the warning alert message by the warning device from a governmental organization;

determining by the system controller whether to issue an alarm system alert based on at least one aspect of the detected warning alert message;

providing, from the hazard alarm notification appliance, notification of the alarm system alert if it is determined to issued the alarm system alert;

receiving, by the system controller, data from the hazard detector in order to determine whether to issue a hazard detector alert; and sending, by the system controller, the hazard detector alert to the at least one hazard notification appliance if the system controller determines to issue the hazard detector alert.

25. The method of claim 24, wherein the warning alert message comprises a type of warning alert message; and determining whether to issue an alarm system alert based on at least one aspect of the warning alert message is based on the type of warning alert message.

26. The method of claim 24, further comprising determining how to issue the alarm system alert.

27. The method of claim 26, wherein the hazard alarm system comprises a plurality of notification appliances; and wherein determining how to issue the alarm system alert comprises selecting a subset of the plurality of notification appliances to issue the alarm system alert.

28. The method of claim 27, wherein the notification appliance selected comprises an annunciator.

29. The method of claim 24, further comprising determining where to issue the alarm system alert.

30. The method of claim 29, wherein the hazard alarm system comprises a plurality of areas monitored; and wherein determining where to issue the alarm system alert comprises selecting a subset of the plurality of areas in which to issue the alarm system alert.

31. The method of claim 24, further comprising determining what to issue as the alarm system alert.

32. The method of claim 31, wherein determining what to issue as the alarm system alert comprises dynamically generating at least a part of the alarm system alert based on a message content in the warning alert message.

33. The method of claim 24:

wherein the hazard alarm system monitors at least one aspect of an area; and further comprising modifying operation of at least one device for monitoring the area based on the warning alert message received.

34. The method of claim 33, wherein the at least one device comprises an environmental control device for the area.

35. The method of claim 34, wherein the environmental control device comprises an HVAC system; and wherein modifying operation comprises modifying flow of air in the HVAC system based on the warning alert message received.

* * * * *